US009028291B2

(12) United States Patent
Martino et al.

(10) Patent No.: US 9,028,291 B2
(45) Date of Patent: May 12, 2015

(54) IMAGE CAPTURING TOY

(75) Inventors: Anthony M Martino, Thousand Oaks, CA (US); Eric C Ostendorff, Torrance, CA (US); Kevin K Cao, Reseda, CA (US); Christopher J Hardouin, Los Angeles, CA (US); David A Sheltman, Rancho Palos Verdes, CA (US); Stacy L O'Connor, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 691 days.

(21) Appl. No.: 13/219,336

(22) Filed: Aug. 26, 2011

(65) Prior Publication Data

US 2012/0052767 A1 Mar. 1, 2012

Related U.S. Application Data

(63) Continuation-in-part of application No. 29/397,872, filed on Jul. 21, 2011, now Pat. No. Des. 685,862, and a continuation-in-part of application No. 29/397,875, filed on Jul. 21, 2011, now Pat. No. Des. 681,742.

(60) Provisional application No. 61/377,383, filed on Aug. 26, 2010.

(51) Int. Cl.

| | |
|---|---|
| ***A63H 33/00*** | (2006.01) |
| ***A63H 17/00*** | (2006.01) |
| ***A63H 17/44*** | (2006.01) |

(52) U.S. Cl.

CPC ..... *A63H 17/00* (2013.01); *A63H 33/00* (2013.01); *A63F 2250/287* (2013.01); *A63H 17/44* (2013.01)

(58) Field of Classification Search

CPC ..... A63H 17/00; A63H 17/002; A63H 17/26; A63H 33/00; G03B 17/08; G03B 29/00; A45C 11/38

USPC ..... 446/71, 78, 431, 487, 491, 436, 470; 396/27, 429, 433; 206/316.2

See application file for complete search history.

(56) References Cited

U.S. PATENT DOCUMENTS

| | | | |
|---|---|---|---|
| 4,132,028 | A | 1/1979 | Ogawa |
| 4,193,639 | A | 3/1980 | Pauly et al. |

(Continued)

FOREIGN PATENT DOCUMENTS

| | | |
|---|---|---|
| DE | 19902852 | 7/2000 |
| EP | 0281427 | 9/1988 |

(Continued)

OTHER PUBLICATIONS

Www.halfbakery.com; "A Matchbox Car Camera: Inside Perspective on Toy Car Stunts"; Jul. 12, 2000; 3 pages; http://www.halfbakery.com/idea/A_20Matchbox_20Car_20_Camera.

*Primary Examiner* — Gene Kim
*Assistant Examiner* — Alyssa Hylinkski
(74) *Attorney, Agent, or Firm* — Kolisch Hartwell, PC

(57) ABSTRACT

An image capturing toy may include a toy vehicle that may include at least one wheel and a camera, the camera including a camera lens and/or a housing that may include a first aperture and a wheel chock configured to inhibit displacement of a wheel. The housing may be moveable from an open position in which the toy vehicle may be placed in and removed from the housing, to a closed position in which the housing releasably encases the toy vehicle such that the camera lens is accessible through the first aperture and the wheel chock engages the at least one wheel.

24 Claims, 12 Drawing Sheets

(56) References Cited

U.S. PATENT DOCUMENTS

| | | | | | |
|---|---|---|---|---|---|
| 4,299,051 | A | | 11/1981 | Pauly et al. | |
| 4,406,085 | A | | 9/1983 | Rhodes | |
| 4,986,187 | A | | 1/1991 | Booth et al. | |
| 5,035,382 | A | | 7/1991 | Lissaman et al. | |
| 5,174,593 | A | | 12/1992 | Chapman | |
| 5,250,973 | A | * | 10/1993 | Pijlman | 396/535 |
| 5,350,033 | A | | 9/1994 | Kraft | |
| 5,481,257 | A | | 1/1996 | Brubaker et al. | |
| 5,555,019 | A | | 9/1996 | Dole | |
| 5,596,319 | A | | 1/1997 | Spry | |
| D389,848 | S | * | 1/1998 | James | D16/201 |
| 6,011,932 | A | * | 1/2000 | Craig | 396/433 |
| D423,539 | S | * | 4/2000 | Craig | D16/201 |
| D423,540 | S | * | 4/2000 | Craig | D16/201 |
| 6,128,441 | A | * | 10/2000 | Kamata et al. | 396/25 |
| 6,155,835 | A | | 12/2000 | Shercliff | |
| 6,224,227 | B1 | | 5/2001 | Klootz | |
| 6,264,521 | B1 | | 7/2001 | Hernandez | |
| 6,293,798 | B1 | | 9/2001 | Boyle et al. | |
| 6,497,608 | B2 | | 12/2002 | Ho et al. | |
| 6,520,642 | B1 | | 2/2003 | Chapman | |
| 6,535,793 | B2 | | 3/2003 | Allard | |
| 6,547,624 | B1 | | 4/2003 | Bojesen et al. | |
| 6,568,983 | B1 | | 5/2003 | Peters | |
| 6,612,658 | B1 | | 9/2003 | Oumedian | |
| 6,632,121 | B2 | | 10/2003 | Edmisson et al. | |
| 6,692,329 | B2 | | 2/2004 | Peters | |
| 6,733,360 | B2 | | 5/2004 | Dooley et al. | |
| 6,746,304 | B1 | * | 6/2004 | Liu | 446/454 |
| 6,752,720 | B1 | | 6/2004 | Clapper et al. | |
| 6,811,492 | B1 | | 11/2004 | Arakawa et al. | |
| 6,954,695 | B2 | | 10/2005 | Bonilla et al. | |
| 7,402,964 | B1 | | 7/2008 | Calhoun | |
| 7,445,539 | B2 | | 11/2008 | Laurienzo et al. | |
| 7,494,398 | B2 | | 2/2009 | Laurienzo | |
| 7,704,119 | B2 | | 4/2010 | Evans | |
| 7,731,588 | B2 | | 6/2010 | Templeman | |
| 7,762,731 | B2 | | 7/2010 | Arbuckle et al. | |
| 7,777,969 | B2 | | 8/2010 | Shirono et al. | |
| 2001/0015766 | A1 | | 8/2001 | Marchesini | |
| 2001/0045978 | A1 | * | 11/2001 | McConnell et al. | 348/42 |
| 2002/0106965 | A1 | | 8/2002 | Dooley et al. | |
| 2002/0111117 | A1 | * | 8/2002 | Ho et al. | 446/456 |
| 2003/0190856 | A1 | | 10/2003 | Peters | |
| 2003/0232649 | A1 | | 12/2003 | Gizis et al. | |
| 2004/0251650 | A1 | | 12/2004 | Katsuyama et al. | |
| 2005/0167304 | A1 | * | 8/2005 | Shimamura | 206/316.2 |
| 2006/0223635 | A1 | | 10/2006 | Rosenberg | |
| 2006/0293102 | A1 | * | 12/2006 | Kelsey | 463/37 |
| 2009/0004948 | A1 | * | 1/2009 | Ando et al. | 446/431 |
| 2009/0140570 | A1 | | 6/2009 | Houkal | |
| 2009/0317069 | A1 | * | 12/2009 | Yim | 396/27 |
| 2010/0081357 | A1 | | 4/2010 | Alles | |
| 2011/0269365 | A1 | * | 11/2011 | Goff et al. | 446/72 |
| 2012/0315820 | A1 | * | 12/2012 | Goff et al. | 446/297 |

FOREIGN PATENT DOCUMENTS

| | | |
|---|---|---|
| EP | 1310280 | 5/2003 |
| JP | 10043439 | 2/1998 |
| WO | 0156676 | 8/2001 |

* cited by examiner

IMAGE CAPTURING TOY

CROSS-REFERENCE TO RELATED APPLICATIONS

This application claims priority under 35 U.S.C. §119 of U.S. Provisional Patent Application Ser. No. 61/377,383, filed Aug. 26, 2010 and entitled IMAGE CAPTURING TOY, U.S. Design patent application Ser. No. 29/397,872, filed Jul. 21, 2011, and U.S. Design patent application Ser. No. 29/397,875, filed Jul. 21, 2011, the disclosures of which are incorporated herein by reference for all purposes.

BACKGROUND

The present disclosure is directed to image capturing toys and, more particularly, to image capturing toys including a toy vehicle having a wheel and a camera and/or a toy housing including a wheel chock and an aperture configured to provide access to the camera.

Examples of toys for capturing and/or displaying a video image are disclosed in U.S. Pat. Nos. 4,986,187, 5,481,257, 5,555,019, 5,596,319, 6,497,608, 6,547,624, 6,568,983, 6,746,304, 6,264,521, 6,547,624, 6,692,329, 6,733,360, 6,752,720, 6,811,492, and 6,954,695; and published applications US20030190856, WO0156676, and EP281427. The complete disclosures of the above patents and/or patent applications are herein incorporated by reference for all purposes.

SUMMARY

The present disclosure provides an image capturing toy. The image capturing toy may include a toy vehicle that may include at least one wheel and a camera, the camera including a camera lens and/or a housing that may include a first aperture and a wheel chock configured to inhibit displacement of a wheel. The housing may be moveable from an open position in which the toy vehicle may be placed in and removed from the housing, to a closed position in which the housing releasably encases the toy vehicle such that the camera lens is accessible through the first aperture and the wheel chock engages the at least one wheel.

An alternative embodiment of an image capturing toy may include a toy vehicle that may include at least one wheel and a camera, the camera including a camera lens, a first housing member configured to cover a portion of the toy vehicle, the first housing member defining a first aperture and/or a second housing member including a wheel chock configured to inhibit displacement of a wheel. The first housing member and the second housing member together may releasably encase the toy vehicle such that the camera lens is accessible through the first aperture and the wheel chock is adjacent the at least one wheel.

An alternative embodiment of the image capturing toy may include a toy vehicle including a front wheel, a rear wheel and a camera, the camera including a functional switch disposed on a top portion of the toy vehicle and a camera lens disposed proximate the front wheel and directed toward the front of the toy vehicle. The image capturing toy may further include a housing defining a cavity substantially conforming to at least the top portion of the toy vehicle, the housing including a first aperture, a second aperture, a front wheel chock, and a rear wheel chock. The front and rear wheel chocks may be configured to inhibit displacement of a wheel in at least one direction. The housing may releasably encase the toy vehicle such that the camera lens is accessible via the first aperture, the functional switch is accessible via the second aperture, the front wheel chock inhibits movement of the front wheel in a first direction and the rear wheel chock inhibits movement of the rear wheel in a second direction.

Advantages of the present disclosure will be more readily understood after considering the drawings and the Detailed Description.

DETAILED DESCRIPTION

Figure 1:
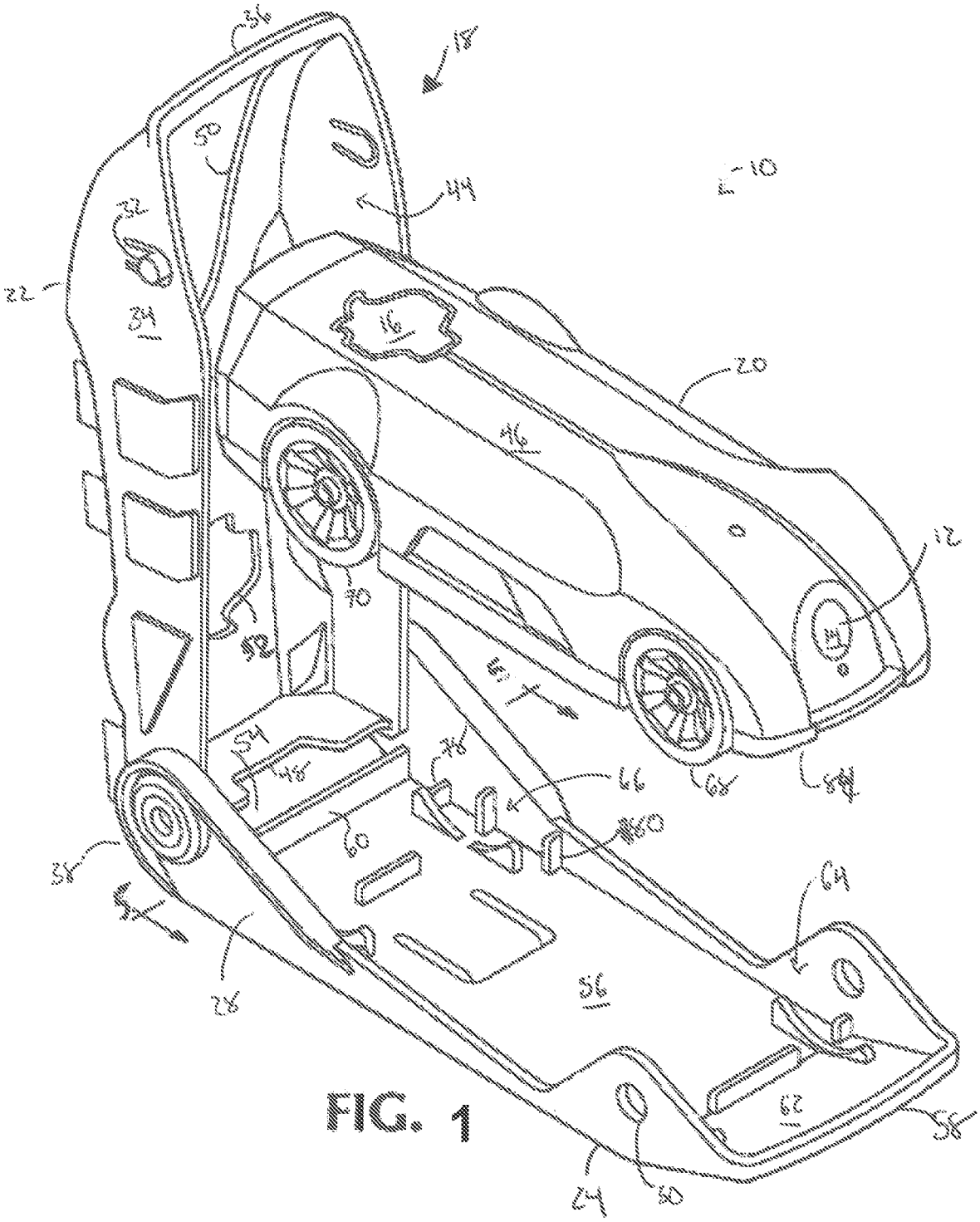
FIG. 1 is a top side perspective view of an image capturing toy, including a toy vehicle and a housing in an open position in accordance with the present disclosure.

An image capturing toy, indicated generally at 10 in FIG. 1 and described in further detail below, is a revolutionary new way to capture thrilling action and stunts. Image capturing toy 10 may include a camera 12, for example a video camera, having a camera lens 14 and/or a functional switch 16 and/or a toy vehicle housing 18 such that image capturing toy 10 has the ability to adapt to multiple play environments. For the purposes of this description, a captured image and/or audio information will additionally be referred to as video, a video, or video file. Camera 12 may be disposed in a toy vehicle 20 for point-of-view video recording. Toy vehicle 20 may be small enough to fit on 1/64 Hot Wheels® track when removed from toy vehicle housing 18.

Image capturing toy 10 may further include editing software via online download or physical memory such as CD-ROM, DVD, or solid state memory separate from or integral with image capturing toy 10. A user may upload captured videos to a computer, edit the videos using software, and share video files over the Internet using such services as YouTube. Users may customize their video clips with cool graphics, transition animations and sound effects.

Figure 2:
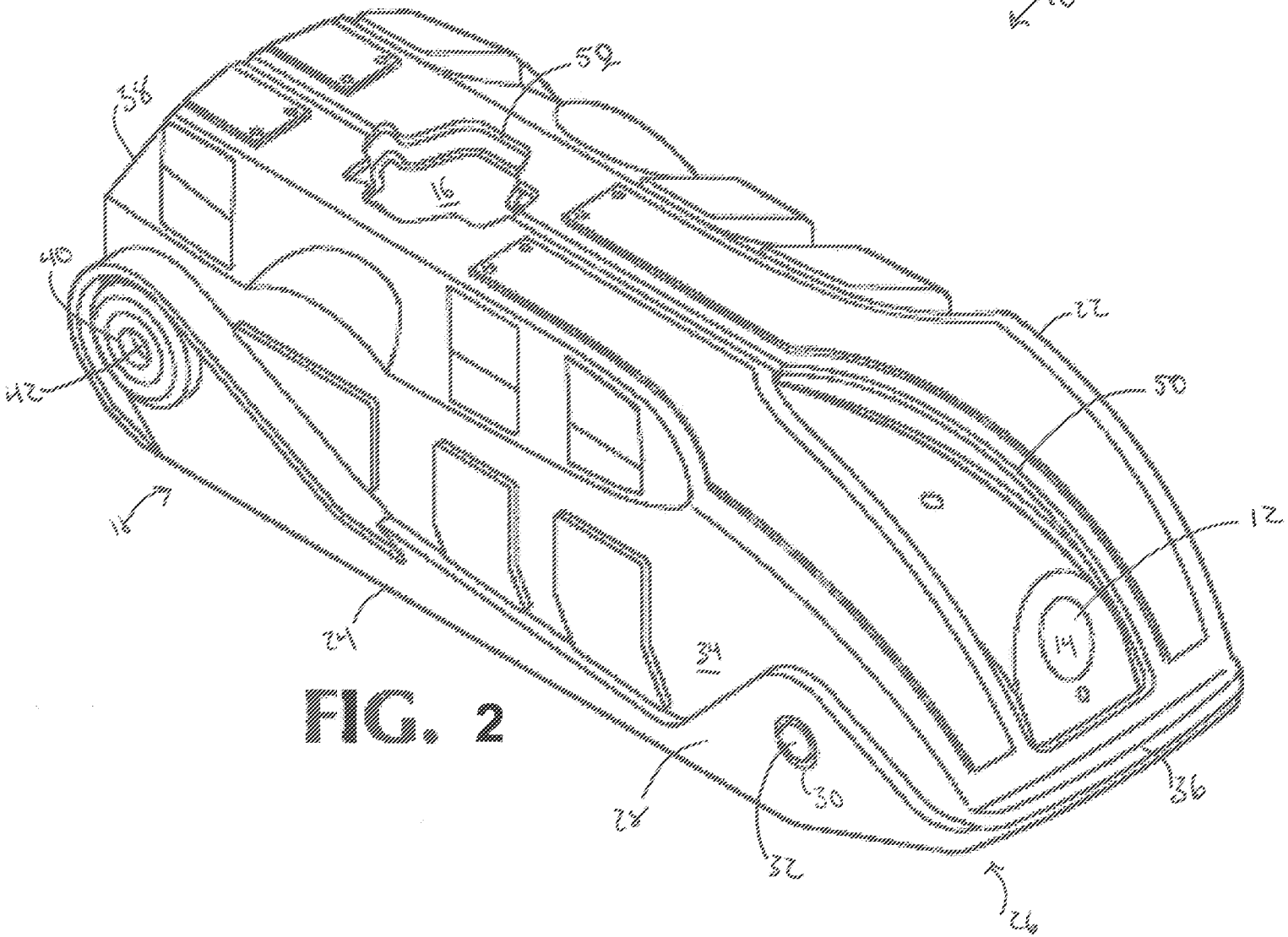
FIG. 2 is a top side perspective view of the image capturing toy of FIG. 1, showing the toy vehicle releasably encased in the housing in a closed position in accordance with the present disclosure.
Figure 3:
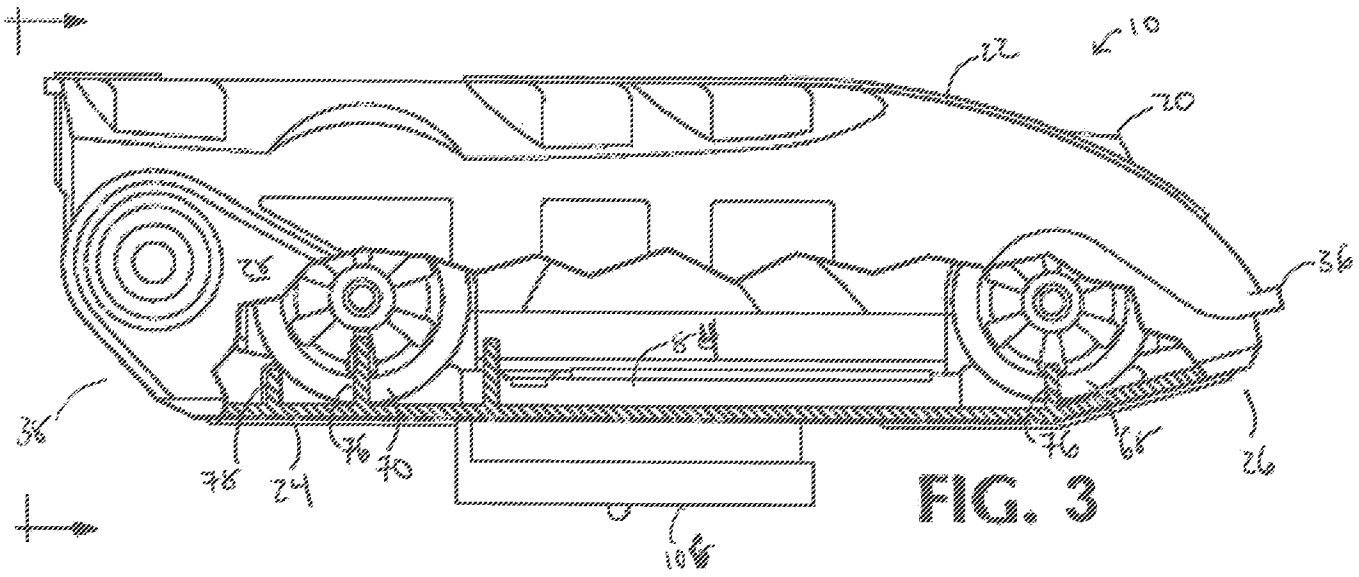
FIG. 3 is a side view of the image capturing toy of FIG. 2, showing a breakaway view of the toy vehicle releasably encased in the housing in accordance with the present disclosure.
Figure 4:
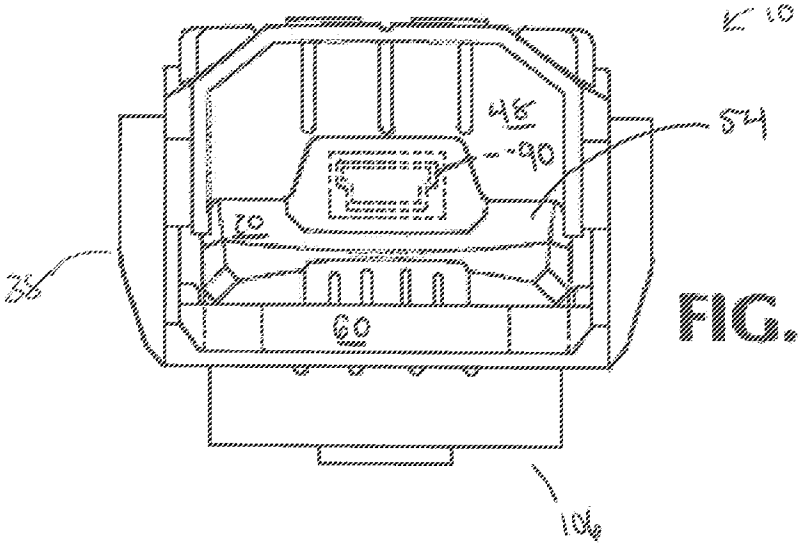
FIG. 4 is a rear view of the image capturing toy of FIG. 2, showing the toy vehicle releasably encased in the housing in accordance with the present disclosure.

FIGS. 1-4 show exemplary image capturing toy 10 including toy vehicle 20 and toy vehicle housing 18, also referred to as housing 18. FIG. 1 shows housing 18 in an open position, in which toy vehicle 20 may be placed in and removed from housing 18, and FIGS. 2-4 show various views of housing 18 in a closed position, in which housing 18 releasably encases toy vehicle 20. FIGS. 5-14 show various views of housing 18 without toy vehicle 20.

Housing 18 may include a first housing member 22 and a second housing member 24, wherein first housing member 22 and second housing member 24 together releasably encase toy vehicle 20. First housing member 22 and second housing member 24 may include a closed position, in which housing 18 releasably encases toy vehicle 20 (FIGS. 2-4) and an open position, in which toy vehicle 20 may be removed from housing 18 (FIG. 1).

Second housing member 24 may be releasably engaged with first housing member 22 at a first end 26 of housing 18. For example, a side wall 28 of second housing member 24 may include a closure aperture 30 in which a closure member 32 extending from a side wall 34 of first housing member 22 may be press fit into. First housing member 22 may include a lip 36 protruding from first end 26 configured to provide leverage for pulling closure member 32 from closure aperture 30 to move housing 18 into the open position. Additionally and/or alternatively, first member side wall 34 may be sufficiently flexible such that pushing side wall 34 inwards releases closure member 32 from closure aperture 30. Alternative embodiments may additionally and/or alternatively include other releasable closure means known to those skilled in the art.

Second housing member 24 may be hingedly attached to first housing member 22 at a second end 38. For example, side wall 28 of second housing member 24 may include a hinge aperture 40 in which a hinge member 42 extending from side wall 34 of first housing member 22 may rotate. As shown, side wall 34 of first housing member 22 is disposed adjacent to the inside of side wall 28 of second housing member 24. Alternatively, the side wall of the first member may be disposed adjacent to the outside of the side wall of the second member and/or the side wall of the first member may include a closure and/or hinge aperture and the side wall of the second member may include a closure and/or hinge member.

First housing member 22 may define a cavity 44 substantially conforming to at least a top portion 46 of toy vehicle 20, also referred to as body 46 of toy vehicle 20, and/or may include a rear wall 48 at second end 38. First housing member 22 may include a first aperture 50 configured to provide access to and/or expose a portion of toy vehicle 20. First aperture 50 may be proximate one of first end 26 and second end 38. In the embodiment shown, first aperture 50 is proximate first end 26 and extends back towards second end 38 in a triangular shape. First housing member 22 may additionally and/or alternatively include a second aperture 52 configured to provide access to and/or expose a portion of toy vehicle 20. Second aperture 52 may be proximate second end 38.

Housing 18 may include a third aperture 54. Third aperture 54 may be defined at second end 38 by first housing member 22 and second housing member 24. Third aperture 54 may be configured to provide access to and/or expose a portion of toy vehicle 20.

Second housing member 24 may include a platform 56 configure to support toy vehicle 20. The platform may extend between second housing member 24 side walls 28 and a first end wall 58 and a second end wall 60. The size of platform 56 may substantially conform to the size of a chassis of toy vehicle 20 (FIG. 1). Platform 56 may be substantially planar and/or may include an inclined portion 62 extending from closure aperture 30 to first end wall 58.

Second housing member 24 may include means to inhibit displacement of toy vehicle 20 when toy vehicle 20 is being supported on platform 56. For example, second housing member 24 may include one or more wheel chocks 64, 66 that may engage a wheel 68, 70. Additionally and/or alternatively, wheel chocks 64, 66 support wheel 68, 70 and/or may be disposed adjacent wheel 68, 70. Wheel chocks 64, 66 may be configured to inhibit displacement and/or movement of wheel 68, 70 in at least one direction.

In some embodiments, wheel chock 64, 66 may be disposed on opposing portions of wheel 68, 70 such that rotation of wheel 68, 70 is inhibited. In other words, one or all of wheel chocks 64, 66 may be configured to inhibit rotation of wheel 68, 70 in one or both of forward and backwards and/or may be configured to inhibit movement/sliding of wheel 68, 70 from side to side or lateral movement.

Second housing member 24 may include a first set of wheel chocks 64, also referred to as the front wheel chocks, and/or a second set of wheel chocks 66 also referred to as the rear wheel chocks, each set including one or more wheel chocks. First set of wheel chocks 64 may be configured to inhibit movement of a front wheel 68 of toy vehicle 20 in at least a first direction and the second set of wheel chocks may be configured to inhibit movement of a rear wheel 70 of toy vehicle 20 in a second direction. The first direction and/or the second direction may include forward movement of wheel 68, 70, rearward movement of wheel 68, 70 and/or lateral movement of wheel 68, 70.

First set of wheel chocks 64 may be disposed proximate first end 26, adjacent second housing member side wall 28, also referred to as the front two corners of platform 56. First set of wheel chocks 64 may include an inclined member 72 having a curvature substantially corresponding to the curvature of front wheel 68. Second set of wheel chocks 66 may be disposed proximate second end 38, adjacent second housing member side wall 28, also referred to as the rear two corners of platform 56. Second set of wheel chocks may include an inclined member 74 having a curvature substantially corresponding to the curvature of rear wheel 70, which may be larger than front wheel 68.

Figure 5:
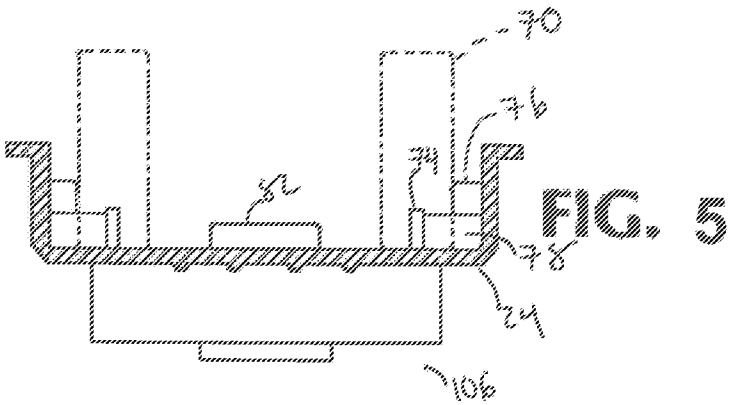
FIG. 5 is a rear view of the image capturing toy of FIG. 1, along lines 5, showing placement of a set of wheels in a set of wheel chocks in accordance with the present disclosure.
Figure 6:
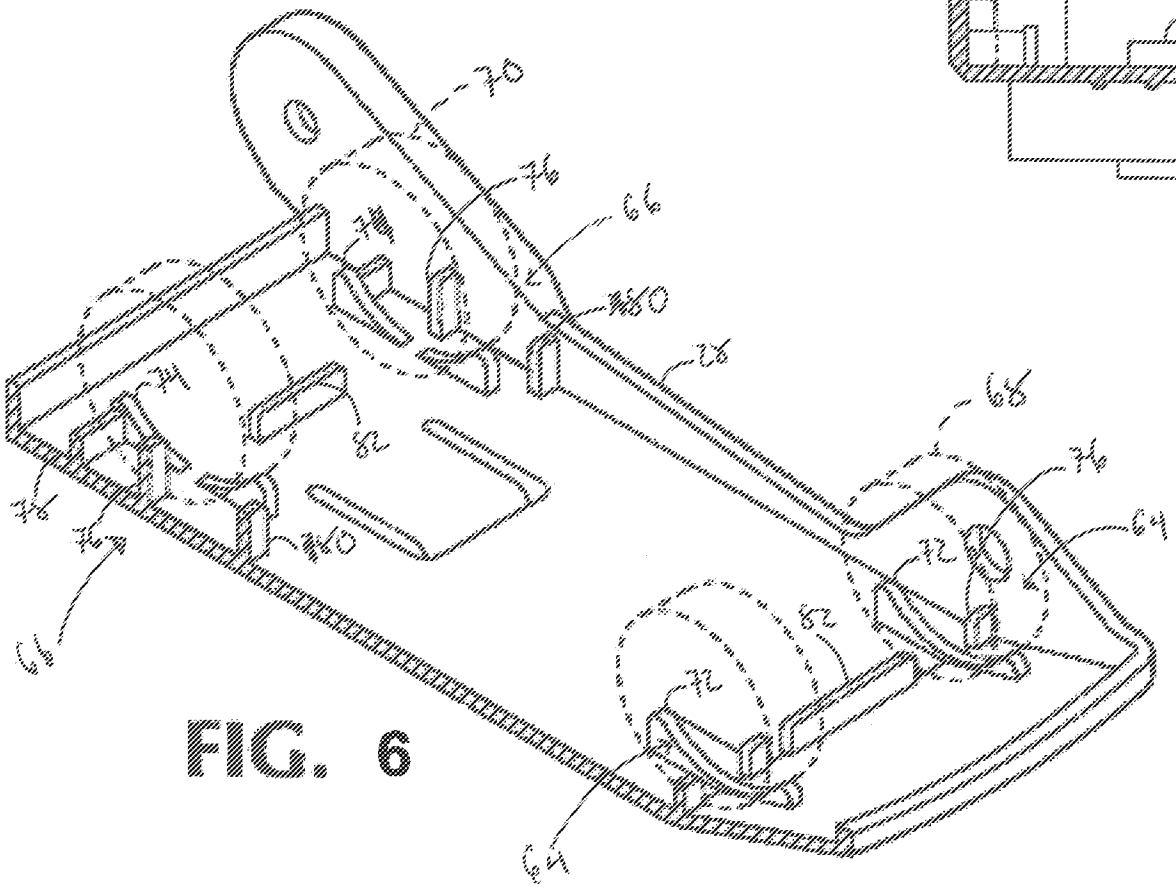
FIG. 6 is an upper perspective view of the image capturing toy of FIG. 1, along lines 5, showing placement of the set of wheels in the set of wheel chocks in accordance with the present disclosure.
Figure 7:
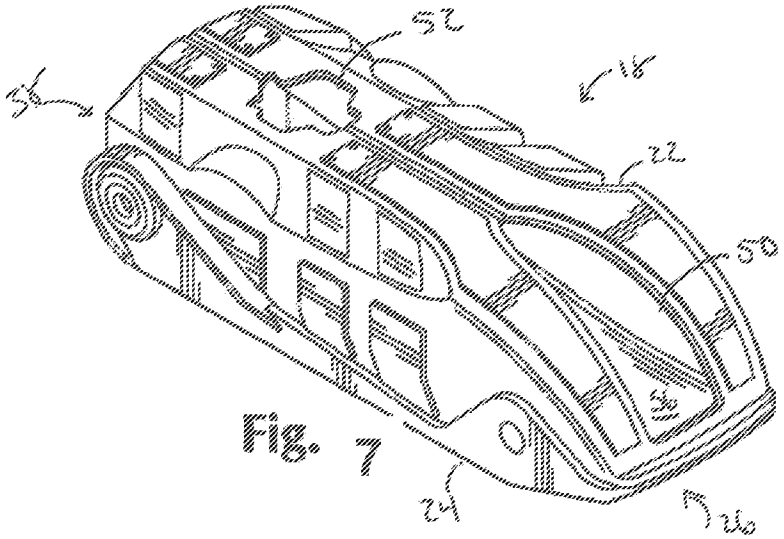
FIG. 7 shows a top front right perspective view of a toy housing in a closed position.
Figure 8:
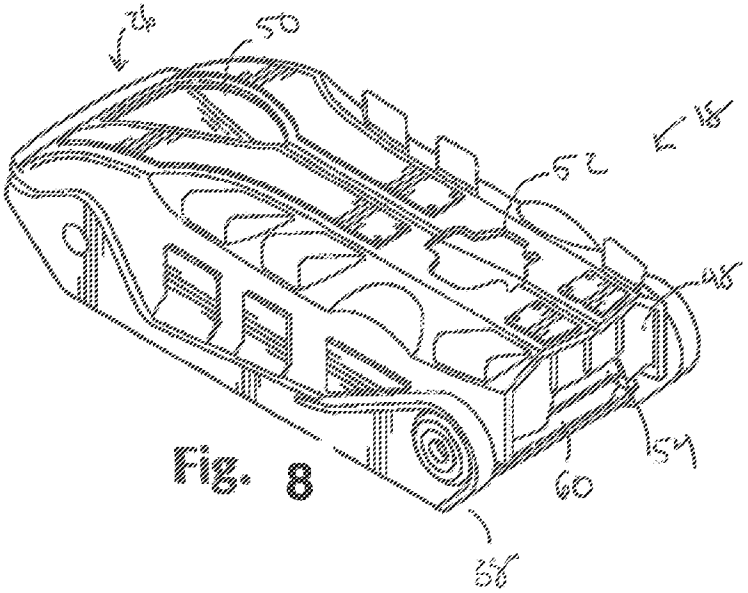
FIG. 8 shows a top rear left perspective view of the toy housing of FIG. 7.
Figure 9:
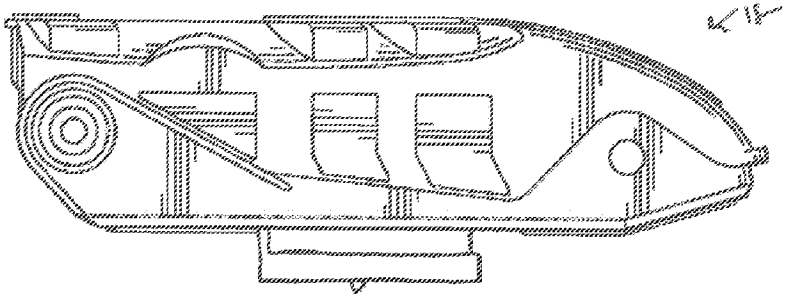
FIG. 9 shows a right side view of the toy housing of FIG. 7.
Figure 10:
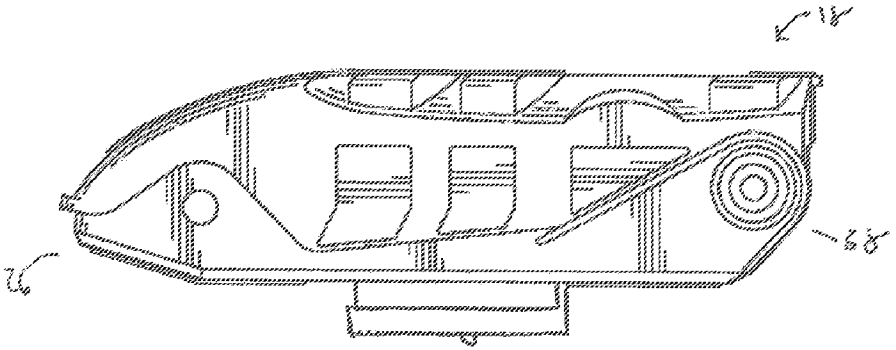
FIG. 10 shows a left side view of the toy housing of FIG. 7.
Figure 11:
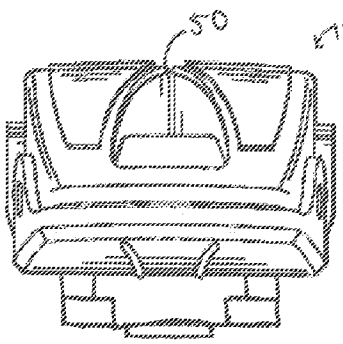
FIG. 11 shows a front view of the toy housing of FIG. 7.
Figure 12:
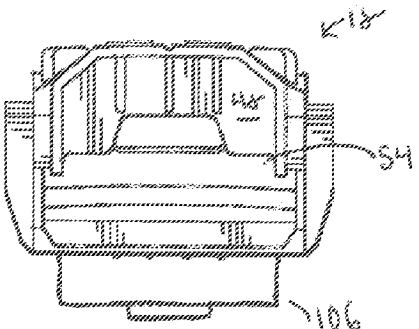
FIG. 12 shows a rear view of the toy housing of FIG. 7.
Figure 13:
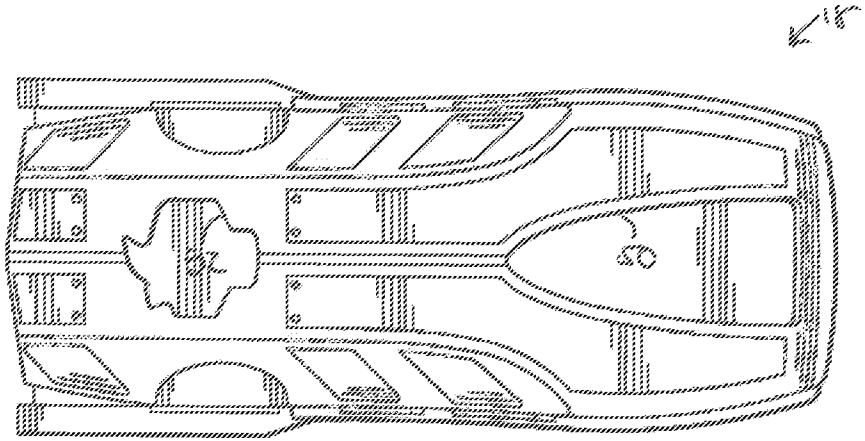
FIG. 13 shows a top view of the toy housing of FIG. 7.
Figure 14:
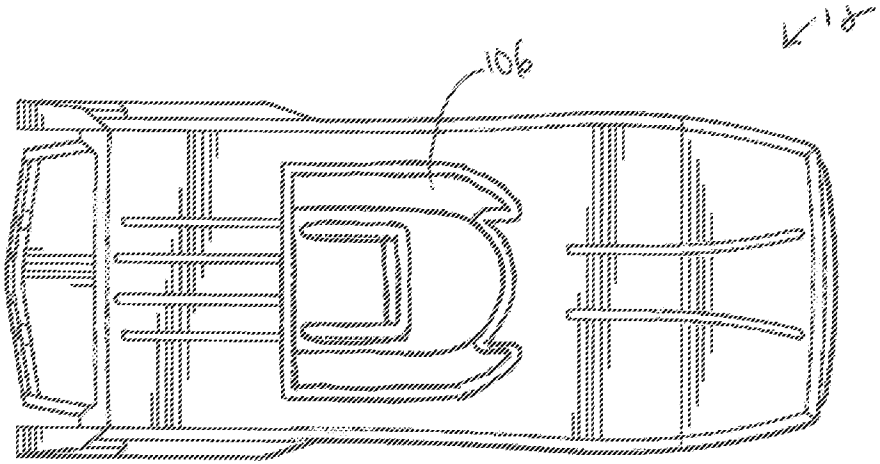
FIG. 14 shows a bottom view of the toy housing of FIG. 7.
Figure 15:
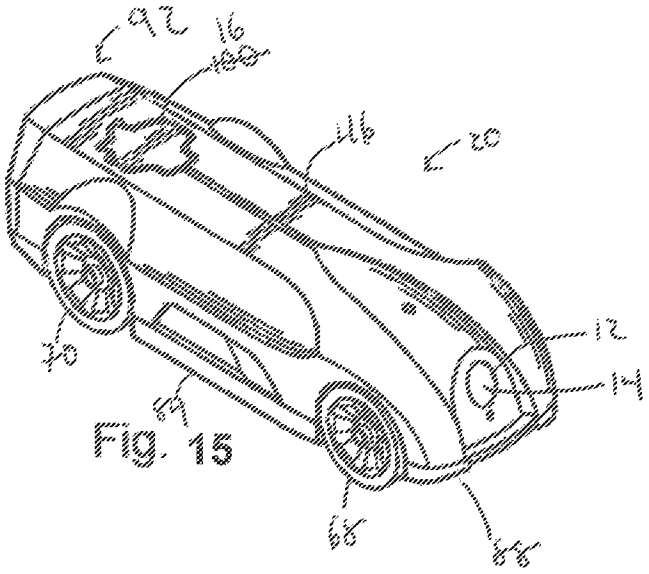
FIG. 15 shows a top front right perspective view of a toy vehicle.
Figure 16:
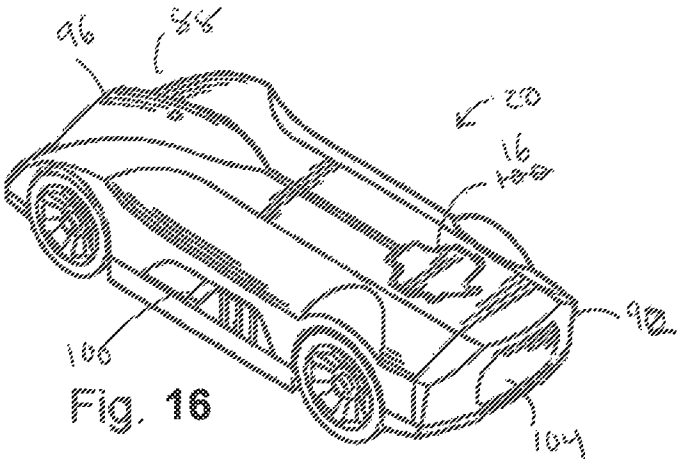
FIG. 16 shows a top rear left perspective view of the toy vehicle of FIG. 15.
Figure 17:
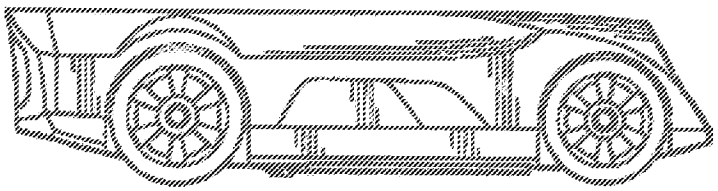
FIG. 17 shows a right side view of the toy vehicle of FIG. 15.
Figure 18:
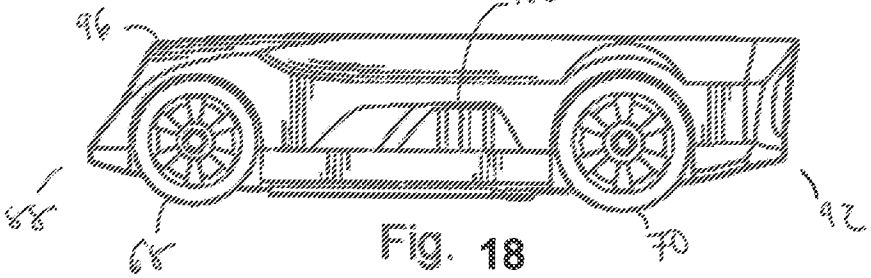
FIG. 18 shows a left side view of the toy vehicle of FIG. 15.

Inclined members 72, 74 may configure to support wheel 68, 70 such that rotation of wheel 68, 70 in one or both of forward rotation or rearward rotation is inhibited. For example, as shown in FIGS. 5 and 6, wheel 68, 70 may be centered on inclined member 72, 74 and inclined member 72, 74 may be disposed proximate the forward and/or the rearward portions of wheel 68, 70.

Wheel chocks 64, 66 may further include a side member 76 that may protrude from side wall 28. Side member 76 may extend from platform 56 to approximately the end of the first member side walls when the first member and the second member are in the closed position. Side member 76 may be configured to inhibit lateral movement of wheel 68, 70. Some embodiments of wheel chocks 64, 66 may further include a block member 78. Block member 78 may extend from platform 56 between the side wall and inclined member 72, 74 and/or may be disposed proximate the rearward portion of wheel 68, 70.

Housing 18 and/or toy vehicle 20 may include additional and/or alternative elements configured to inhibit movement of body 46 and/or chassis of toy vehicle 20. For example, housing 18 may include a side bumper member 80 extending from the side wall. Side bumper member 80 may be configured to inhibit lateral movement of body 46 and/or a chassis 84 of toy vehicle 20.

Additionally and/or alternatively, housing 18 may include an arm 82 extending across a portion of platform 56 and/or perpendicular to side wall 28. Arm 82 may be disposed at a center point of wheel chocks 64, 66. Additionally and/or alternatively, arm 82 may extend partially between first set of wheel chocks 64 and/or second set of wheel chocks 66.

Figure 22:
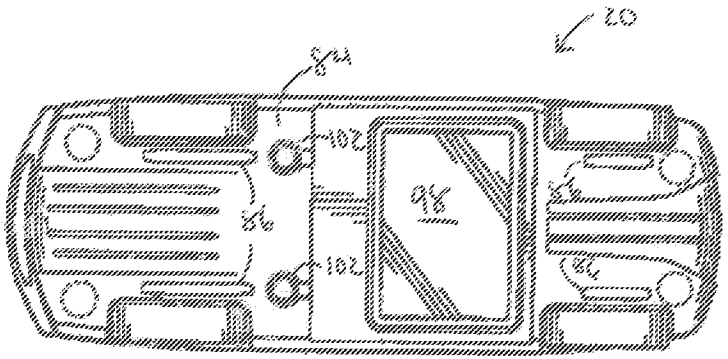
FIG. 22 shows a bottom view of the toy vehicle of FIG. 15.
Figure 24:
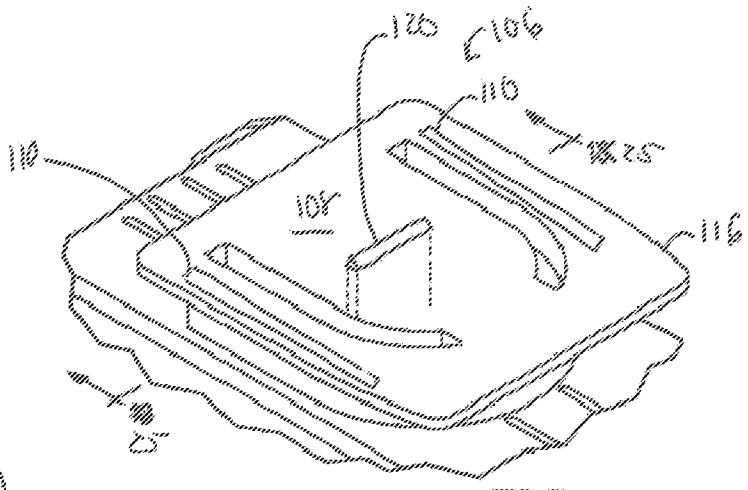
FIG. 24 shows the bracket assembly of FIG. 23, including the second bracket releasably attached to the first bracket in accordance with the present disclosure.
Figure 23:
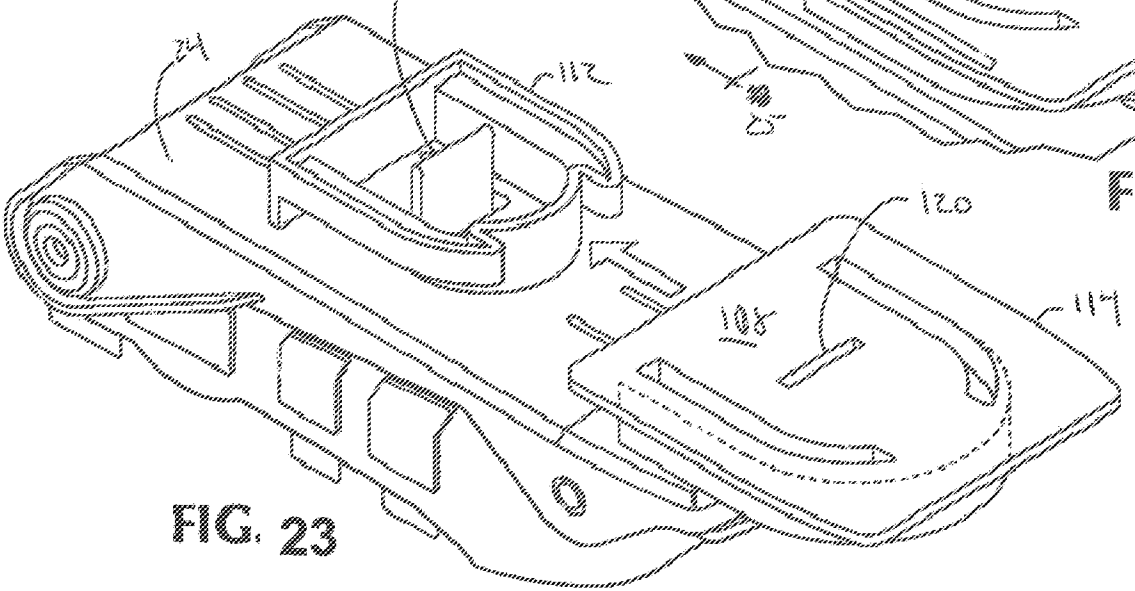
FIG. 23 shows a perspective view of a bracket assembly including a first bracket and a second bracket removed from the first bracket in accordance with the present disclosure.
Figure 26:
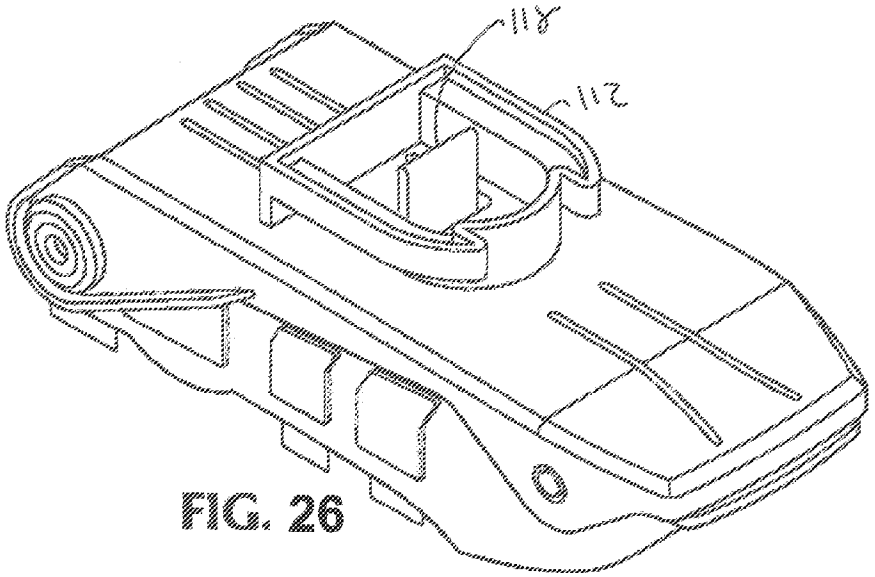
FIG. 26 shows the bracket assembly of FIG. 23 including the first bracket member in accordance with the present disclosure.
Figure 25:
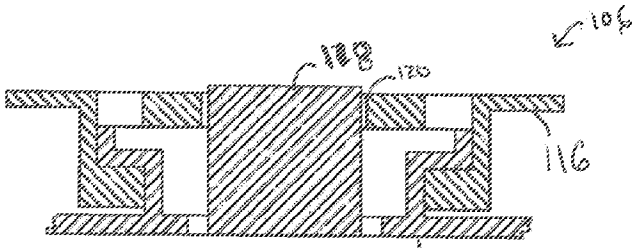
FIG. 25 shows the bracket assembly of FIG. 24 along lines 25 in accordance with the present disclosure.

Arm 82 may be configured to inhibit movement of chassis 84. For example, chassis 84 may include a pair of wings 86 extending from the underside of chassis 84 (FIG. 22). Each of the pair of wings may extend alongside wheel 68, 70. Each of wings 86 may include a curvature and may be configured to abut an end of arm 82 such that lateral movement of chassis 84 may be inhibited.

Figure 20:
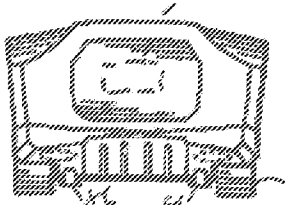
FIG. 20 shows a rear view of the toy vehicle of FIG. 15.
Figure 19:
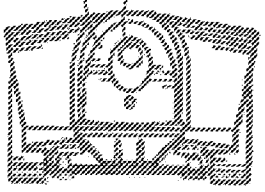
FIG. 19 shows a front view of the toy vehicle of FIG. 15.
Figure 21:
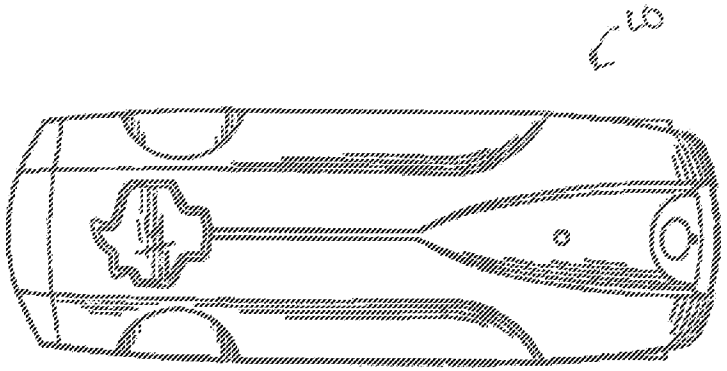
FIG. 21 shows a top view of the toy vehicle of FIG. 15.

Turning now to FIGS. 1-4 and 15-22, toy vehicle 20 may include a substantially rectangular shape including camera lens 14 at a front end 88 and an electrical connector 90 at a rear end 92 (FIGS. 4 and 20). Front end 88 may include a recessed area 94 having an awning 96, in which camera lens 14 may be inserted such that the view of camera lens 14 is unobstructed, however, camera lens 14 is at least partially concealed and/or protected by body 46. In some embodiments, front end 88 may resemble an automobile hood having a "turbo bulge". In housing 18 closed position, camera lens 14 may be accessible via first aperture 50.

Toy vehicle 20 may include body 46, also referred to as upper portion 46, and chassis 84, also referred to as lower portion 84. Internal components may be sandwiched between body 46 and chassis 84. Internal components may be operatively connected and may include, but are not limited to, camera lens 14, camera 12, such as a video camera or a still camera, a printed circuit board (PCB), a power source, an image display 98, such as a Liquid Crystal Display (LCD), and/or electrical connector 90. The power-source may include one or more AAA batteries, rechargeable batteries, or USB chargeable power-source.

Other embodiments may include a charge coupled device (CCD), a processor, an audio sensor, for example a microphone, and/or an image/audio memory. In some embodiments, image capturing toy 10 may include a card slot for memory expansion. Various memory cards are available, with microSD cards being particularly convenient and small.

Image capturing toy 10 may include one or more manual inputs and/or may be controlled remotely via any means known to those skilled in the art. Manual inputs, such as functional switch 16, also referred to as record button 16, an on/off toggle 100, and one or more play/stop/pause/trash buttons 102 may be pressed, shifted or otherwise manipulated to perform one or more of the following functions: power on/off, record, play/stop/pause, store and/or trash a captured video.

Functional switch 16 may be disposed on the top of body 46. In housing 18 closed position, functional switch 16 may be assessable via second aperture 52. In some embodiments, functional switch 16 may include an illumination device, such as an LED light that may remain illuminated while toy vehicle 20 is powered on.

Image capturing toy 10 may include the ability to record video and/or sound and download data via a USB to a computer. For example, electrical connector 90 may be integrated into toy vehicle 20 and may be operatively connected to the processor. Electrical connector 90 may include a mini-USB, mini-HDMI, mini-DVI or similar interface and may be capable of performing such functions as 1) outputting image or stored data files from image memory to a computer, a TV, or a similar audio and/or visual device; 2) inputting image or other data files onto image memory; 3) inputting a software and/or firmware update to image capturing toy 10; or 4) charging power-source. Electrical connector 90 may be protected from the elements by a clear removable plastic plug 104. In housing 18 closed position, electrical connector 90 may be assessable via third aperture 54.

Some embodiments may include LCD screen 98, also referred to as image display 98, for example located on the bottom of chassis 84. LCD screen 98 may allow easy preview of recorded video action. Housing 18 may substantially cover image display 98 in the closed position. Additionally and/or alternatively, in some embodiments, image capturing toy 10 may include a headphone jack for audio output.

Turning now to FIGS. 3-5 and 23-26, some embodiments of image capturing toy 10 may include a bracket assembly 106 configured to releasably attach image capturing toy 10 to one or all of a belt and/or a planar or solid surface such as a helmet, bike, skateboard, clothing, etc. Bracket assembly 106 may extend from the bottom of second housing member 24. Bracket assembly 106 may include a substantially planar surface 108 and/or one or more loops 110 configured to permit a belt to be threaded through. The substantially planar surface 108 may be coated or attached with an adhesive layer to aid in its releasable attachment with a planar or solid surface.

Bracket assembly 106 may include a first bracket 112 fixed to housing 18 and a second bracket 114, 116 removably attachable to first bracket 112, wherein second bracket 114, 116 is configured for attachment to one of a belt 116 and a solid surface 114. Second bracket 114, 116 may slide onto first bracket 112 as shown by directional arrow in FIG. 23. Second bracket 114, 116 may be releasably locked into place via a flexible locking member 118 extending from housing 18. Flexible locking member 118 may be inserted into a locking aperture 120 to securely join first and second bracket 112, 114, 116.

Housing 18 may include other attachment means, such as a loop, such that image capturing toy may be worn by user, for example as a necklace or wristband, or attached to a third object such as a key chain or bike lock.

Operation of the image capturing toy may be as follows. To power-on the image capturing toy, a user may shift an on/off toggle and/or press, hold, and release the record button. Once powered on, the image capturing toy may show an image on image display. Pressing the record button a second time may capture and/or store a video file on an image memory. Pressing the record button a third time may stop capturing video. Pressing the record button a fourth time may resume capturing video. A user may press, hold, and release the record button to power-off the image capturing toy.

After powering on the image capturing toy, a user may press play/stop button to access and view a first stored and/or captured video file on image display. Pressing play button a second time may pause a video file, and a third press of play button may resume a paused video file. Pressing and holding play button may allow access to a second stored and/or captured video file.

Some embodiments of image capturing toy may include a trash button. While the image capturing toy is powered-on, pressing trash button may delete a stored and/or captured video, however the image capturing toy may display a prompt on image display to confirm deletion, pressing trash button a second time may confirm deletion and cause a video file to be purged from image memory making additional memory available. Some embodiments of image capturing toy may further include a reset button that may be used to power-off the image capturing toy. Additionally and/or alternatively otherwise the image capturing toy may power-off after a certain amount of inactivity.

During operation, the image display may provide a user with visual representations to communicate functions that may be performed, are being performed and/or have been preformed. For example, a miniature camcorder may appear in a lower right corner of image display to indicate image sensor is ready to record. Once recording begins, image display may display record time along with a flashing record symbol. Additionally, image display may display a low battery, low memory, and/or delete memory graphic during operation. In some embodiments, additionally and/or alternatively, the image capturing toy may include a LED that may flash different flashing patterns if an image capturing toy has either low memory or low battery power. Moreover, before a video is viewed/played, image display may display a unique file name associated with each video to indicate which video is being viewed/played.

As discussed above, the electrical connector may be used for connecting the image capturing toy to a computer, which may allow a user to edit captured audio and visual information using software located on any or all of memory inside the image capturing toy, memory inside a computer, a CD-ROM (or similar data storage device) or on the Internet. In some embodiments, however, the image capturing toy may include software and/or additional manual inputs to allow editing without a computer. This may allow a user to view and edit video directly after capturing video.

Editing Tools may include: Timeline edit, Filters, Graphics, and Dubs. Using timeline edit, a user may be able to edit the length, order, and speed of captured audio and/or visual information. Using filters, a user may be able to filter captured images and/or video files by, for example, warping, applying black and white filters, and/or applying sepia tone filters. Using graphics, a user may be able to drop in thought bubbles, checkered flags, popping hearts, and other graphical elements. Using dubs, a user may be able to supplement captured audio information and/or video files with sound effects that may be included in a bank of sound effects. Additionally, a user may be able supplement captured audio information and/or video files with user recorded sounds or videos. After editing is complete, a user may share video files with other users.

The various embodiments of the illustrated the image capturing toy, and the various components, if present, may be fabricated from any suitable material, or combination of materials, such as plastic, foamed plastic, wood, cardboard, pressed paper, metal, or the like. A suitable material may be selected to provide a desirable combination of weight, strength, durability, flexibility, cost, manufacturability, appearance, safety, and the like.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. An image capturing toy comprising:

a toy vehicle including at least one wheel and a camera, the camera including a camera lens disposed on a front of the toy vehicle and a record button disposed on a top of the toy vehicle that causes the camera to capture and store a video file on an image memory; and a housing including a first aperture, a second aperture, and a wheel chock configured to inhibit displacement of a wheel;

wherein the housing is moveable from an open position in which the toy vehicle may be placed in and removed from the housing, to a closed position in which the housing releasably encases the toy vehicle such that the camera lens is accessible through the first aperture, the record button is accessible through the second aperture, and the wheel chock engages the at least one wheel.

2. The image capturing toy of claim 1, wherein the wheel chock is disposed on opposing portions of the at least one wheel such that rotation of the at least one wheel is inhibited.

3. The image capturing toy of claim 1, wherein the wheel chock further includes a side member configured to inhibit lateral movement of the at least one wheel.

4. The image capturing toy of claim 1, wherein the first aperture is defined by a first housing member configured to cover a portion of the toy vehicle, and the wheel chock is disposed in a second housing member; and wherein the first housing member and the second housing member together releasably encase the toy vehicle.

5. The image capturing toy of claim 1, wherein the toy vehicle further includes an electrical connector and the housing includes a third aperture, the electrical connector being accessible through the third aperture when the toy vehicle is inside the housing and the housing is in the closed position.

6. The image capturing toy of claim 1, wherein the housing further includes a bracket assembly configured to removably attach the housing to one of a belt and a solid surface.

7. The image capturing toy of claim 6, wherein the bracket assembly includes a first bracket fixed to the housing and a second bracket removably attachable to the first bracket, wherein the second bracket is configured for attachment to one of a belt and a solid surface.

8. The image capturing toy of claim 1, wherein the wheel chock includes an inclined member having a curvature substantially corresponding to the curvature of the wheel, the inclined member configured to support the wheel such that rotation of the wheel is inhibited.

9. The image capturing toy of claim 1, wherein the toy vehicle further comprises an image display, the housing substantially covering the image display in the closed position.

10. An image capturing toy comprising:

a toy vehicle including at least one wheel and a camera, the camera including a camera lens toward a front of the toy vehicle and a record button on a top portion of the toy vehicle that causes the camera to capture and store an image;

a first housing member configured to cover a portion of the toy vehicle, the first housing member defining a first aperture and a second aperture; and a second housing member including a wheel chock configured to inhibit displacement of a wheel;

wherein the first housing member and the second housing member together releasably encase the toy vehicle such that the camera lens is accessible through the first aperture, the record button is accessible through the second aperture, and the wheel chock is adjacent the at least one wheel.

11. The image capturing toy of claim 10, wherein the toy vehicle further includes an electrical connector that is accessible when the first housing member and the second housing member releasably encase the toy vehicle.

12. The image capturing toy of claim 10, wherein the wheel chock further includes a side member configured to inhibit lateral movement of the at least one wheel.

13. The image capturing toy of claim 10, wherein the second housing member includes a bracket assembly configured to removably attach the second housing member to one of a belt and a solid surface.

14. The image capturing toy of claim 13, wherein the bracket assembly includes a first bracket fixed to the second housing member and a second bracket removably attachable to the first bracket, wherein the second bracket is configured for attachment to at least one of a belt and a solid surface.

15. The image capturing toy of claim 10, wherein the wheel chock includes an inclined member having a curvature substantially corresponding to the curvature of the wheel, the inclined member configured to support the wheel such that rotation of the wheel is inhibited.

16. The image capturing toy of claim 10, wherein the toy vehicle includes an image display that is not accessible when the first housing member and the second housing member releasably encase the toy vehicle.

17. An image capturing toy comprising:

a toy vehicle including a front wheel, a rear wheel and a camera, the camera including a functional switch disposed on a top portion of the toy vehicle and a camera lens disposed adjacent the front wheel and directed toward the front of the toy vehicle; and a housing defining a cavity substantially conforming to at least the top portion of the toy vehicle, the housing including a first aperture, a second aperture, a front wheel chock, and a rear wheel chock;

wherein the front and rear wheel chocks are configured to inhibit displacement of a wheel in at least one direction; and wherein the housing releasably encases the toy vehicle such that the camera lens is accessible via the first aperture, the functional switch is accessible via the second aperture, the front wheel chock inhibits movement of the front wheel in a first direction and the rear wheel chock inhibits movement of the rear wheel in a second direction.

18. The image capturing toy of claim 17, wherein one of the front wheel chock and the rear wheel chock is disposed on opposing portions of a wheel.

19. The image capturing toy of claim 17, wherein the toy vehicle further includes an electrical connector disposed proximate the rear wheel and opposite the camera lens, and the housing includes a third aperture, the electrical connector being accessible via the third aperture.

20. The image capturing toy of claim 17, wherein the housing includes a first housing member and a second housing member having a closed position in which the housing releasably encases the toy vehicle and an open position in which the toy vehicle may be removed from the housing.

21. An image capturing toy comprising:

a toy vehicle including a front wheel, a rear wheel and a camera, the camera including a camera lens disposed adjacent the front wheel and directed toward the front of a toy vehicle and a functional switch disposed on a top of the toy vehicle;

a first housing member having a first end and a second end, the first housing member including a first aperture proximate one of the first end and the second end and including a second aperture; and a second housing member removably engaged with the first housing member at the first end and hingedly attached to the first housing member at the second end, the second housing member including two wheel chocks disposed proximate one of the first end and the second end;

wherein the first housing member and the second housing member are configured to releasably and securely encase the toy vehicle such that the camera lens is accessible through the first aperture and the functional switch is accessible via the second aperture.

22. The image capturing toy of claim 21, wherein the two wheel chocks include inclined members having a curvature substantially corresponding to the curvature of the wheels, wherein the inclined members are configured to support one of the wheels such that rotation of the one of the wheels is inhibited.

23. The image capturing toy of claim 22, wherein the two wheel chocks further include a side member configured to inhibit lateral movement of the one of the wheels.

24. The image capturing toy of claim 21, wherein the second housing member includes a platform having four corners and the two wheel chocks are disposed proximate to two of the four corners.

* * * * *